US006143996A

United States Patent [19]

Skanda

[11] Patent Number: 6,143,996

[45] Date of Patent: Nov. 7, 2000

[54] OUTLET FOR CONNECTING A VACUUM-CLEANING HOSE TO A CENTRALIZED VACUUM-CLEANING INSTALLATION

[75] Inventor: Sri Rajah Skanda, Ampang Selangor, Malaysia

[73] Assignee: Aldes Aeraulique, Venissieux, France

[21] Appl. No.: 09/193,543

[22] Filed: Nov. 17, 1998

[30] Foreign Application Priority Data

Nov. 18, 1997 [FR] France ..... 97 14683

[51] Int. Cl.[7] ..... H01H 3/16; A47L 5/38; H01R 13/703

[52] U.S. Cl. ..... 200/61.6; 15/314; 439/373

[58] Field of Search ..... 15/314, 315; 55/DIG. 8; 137/360, 361, 362; 439/373, 191–195; 200/61.6

[56] References Cited

U.S. PATENT DOCUMENTS

| | | | |
|---|---|---|---|
| 1,255,176 | 2/1918 | Kellogg | 105/301 |
| 3,076,068 | 1/1963 | Backlyeft | 200/61.6 |
| 3,083,396 | 4/1963 | Senne et al. | 15/319 |
| 3,291,927 | 12/1966 | Riley, Jr. et al. | 200/61.6 |
| 3,387,319 | 6/1968 | Ferraris et al. | 15/327.7 |
| 3,434,092 | 3/1969 | Brown et al. | 200/61.6 X |
| 3,465,111 | 9/1969 | Breslin | 200/61.6 |
| 3,639,711 | 2/1972 | Jordan et al. | 200/83 R |
| 3,655,927 | 4/1972 | Samuelson et al. | 200/61.6 |
| 3,706,184 | 12/1972 | Tucker | 15/314 X |
| 3,942,963 | 3/1976 | Tevis | 15/314 X |
| 4,336,427 | 6/1982 | Lindsay | 200/61.6 |
| 5,191,673 | 3/1993 | Damizet | 15/256.5 |
| 5,349,146 | 9/1994 | Radabaugh | 200/61.6 |

FOREIGN PATENT DOCUMENTS

| | | | |
|---|---|---|---|
| 0165908 | 12/1985 | European Pat. Off. | A47L 5/38 |
| 1534667 | 8/1968 | France . | |
| 2647510 | 11/1990 | France | A47L 5/38 |
| 2240466 | 8/1991 | United Kingdom | A47L 5/38 |

*Primary Examiner*—J. R. Scott
*Attorney, Agent, or Firm*—Cantor Colburn LLP

[57] ABSTRACT

The present invention is directed to an outlet for connecting a vacuum-cleaning hose to a centralized vacuum-cleaning installation. The outlet comprises a tubular body mounted in a surface of a fitted-out room at right angles to the surface and includes an open end which is plugged elastically and sealed by retractable member. The tubular body is connected by a member (e.g., pipe) to the vacuum cleaning unit, and the tubular body further includes a means of relaying control information for switching the unit on. At one end of a vacuum-cleaning hose is an end-fitting which is intended to be engaged in the tubular body. The end-fitting includes means for angularly positioning the end-fitting and means of fixing it in the tubular body at the end of its engagement travel therein. The end-fitting also includes an opening arranged opposite the pipe which is connected to the vaccuum-cleaning unit.

23 Claims, 6 Drawing Sheets

13
10
3
8
7
9
12
6
4
5
2
17
16
18
19
15

13
10
9
3
8
7
16
18
19
12
17
6
4
5
2
15
14

OUTLET FOR CONNECTING A VACUUM-CLEANING HOSE TO A CENTRALIZED VACUUM-CLEANING INSTALLATION

The subject of the present invention is an outlet for connecting a vacuum-cleaning hose to a centralized vacuum-cleaning installation.

1. BACKGROUND OF THE INVENTION

A centralized vacuum-cleaning installation is made up of a vacuum-cleaning unit installed in a plant room, and of vacuum-cleaning outlets installed in the various rooms of a building used for dwellings, an office building or a building open to the public, the outlets being connected to the vacuum-cleaning unit by a network of smooth-bore pipes.

The vacuum-cleaning outlets are used to connect the network of vacuum-cleaning pipes to a brush used for vacuum cleaning, this brush being fixed to a flexible tube, the other end of which is equipped with an end-fitting intended to be introduced into an outlet connecting the flexible hose to the vacuum-cleaning unit and switching this unit on, for example by means of a microcontact fixed in the outlet.

2. DESCRIPTION OF THE PRIOR ART

Document FR 1,534,667 relates to a centralized vacuum-cleaning installation comprising flexible-tube connection boxes housed in the walls of the room that is to be equipped. Each box is closed by a flap that has to be opened manually before the end-fitting of the flexible tube can be introduced. Sealing upon closure is supplemented by a spherical plug which can be retracted during vacuum-cleaning periods.

The vacuum-cleaning outlets are mounted either in the floor, or more generally towards the bottom of a partition wall. These outlets are generally covered with a flap which has to be pivoted outwards before the connecting end-fitting of the vacuum-cleaning hose can be engaged. Such an arrangement has the drawback that furniture cannot be installed where the outlets are, and this is particularly inconvenient in office buildings where rearrangements are frequent and where the office partitions may be moved. In any event, the vacuum-cleaning outlets need to be easily accessible to those who do the vacuum-cleaning. It would be desirable, especially in office buildings which have a false ceiling, for the vacuum-cleaning outlets to be located in the ceiling, so that these outlets would not be an impediment to the siting of furniture or of partitions.

However, in such a case there is then the problem of introducing the end-fitting of the flexible hose into the body of the outlet.

3. SUMMARY OF THE INVENTION

The object of the invention is to provide an outlet for connecting a vacuum-cleaning hose to a centralized vacuum-cleaning installation, in which the body of the outlet can be fitted with equal ease into the floor, into a wall or into the ceiling, while at the same time allowing the end-fitting of the flexible hose to be introduced easily and immediately into the body of the outlet and the installation to be automatically switched on, even if the operator is some distance from the body of the outlet.

To this end, the outlet to which it relates comprises:

a tubular body mounted in a surface of the fitted-out room, be this the ceiling, the wall or the floor, at right angles to this surface and having, on the same side as the surface, an open end which, plugged elastically and sealed by retractable means forms a conical entry at the same end as the inside of the room, this tubular body being connected by a pipe to the vacuum-cleaning unit and comprising a means of relaying control information for switching the unit on, which means is actuated when the means of plugging the tubular body are in the open position, and a rigid tubular end-fitting which, mounted at one end of the vacuum-cleaning cleaning hose, is intended to be engaged in the tubular body, this end-fitting comprising means for angularly positioning it, and means for fixing it in the tubular body at the end of its engagement travel therein, the end-fitting comprising an opening arranged opposite the pipe connected to the vacuum-cleaning unit when it is at the end of its engagement travel in the tubular body.

Advantageously, the end-fitting is fixed to one end of a length of rigid tube, to the other end of which a flexible hose is fixed.

In order to allow a connection with an outlet which is not directly accessible, the length of rigid tube is of adjustable length, being made from several rigid elements joined together end to end or which are telescopic.

The means of relaying control information for switching the unit on consist, for example, of an electrical contact formed as a part of a microswitch.

A vacuum-cleaning hose is connected to the outlet simply by engaging the end-fitting associated with the hose into the tubular body of the outlet. This movement, which can be performed easily on account of the conical entry to the tubular body, causes the means that plug the tubular body to be retracted, placing the vacuum-cleaning hose in communication with the network of pipes which is connected to the vacuum-cleaning unit, and switching the vacuum-cleaning unit on. In so far as the tubular body of the outlet is located in the ceiling, the end-fitting is fixed to one end of a length of rigid tube, to the other end of which a flexible hose is fixed.

If the length of rigid tube is a few tens of centimeters long, the operator can easily, using this length of rigid tube, introduce the end-fitting into the tubular body in order to switch the unit on, and remove the end-fitting from the tubular body at the end of vacuum-cleaning.

In a first embodiment of this outlet, the pipe connected to the vacuum-cleaning unit is at right angles to the tubular body, the means of plugging the tubular body consisting of a piston pushed into its closed position by a spring and sliding between a plugging position in which it plugs off the pipe connected to the unit and a retracted position, in which the end-fitting is at the end of its engagement travel in the tubular body and allows the vacuum-cleaning hose to communicate with the pipe connected to the vacuum-cleaning unit.

In another embodiment of this outlet, the means of plugging the tubular body consist of a flap made of one or more parts, subject to the action of a spring which keeps it in the closed position, each part of which flap is articulated about an axis that is at right angles to the axis of the body, near to that end thereof which is located in the vicinity of the surface, so that it can pivot into the body as the end-fitting is introduced.

The means of relaying control information for switching the unit on may be actuated either by means of plugging the tubular body, for example a piston or a flap, or by the end-fitting itself, at the end of its engagement into the tubular body.

According to one feature of the invention, the means for the angular positioning of the end-fitting with respect to the tubular body consist of a system of complementary slots and ribs formed respectively in the tubular body and in the end-fitting.

Even if the end-fitting of the tubular body has a rectangular cross section, it is advantageous for there to be means for angularly positioning the end-fitting, if the opening that places the vacuum-cleaning hose in communication with the vacuum-cleaning unit is formed laterally in the end-fitting.

When the body and the end-fitting are of circular cross section, the means of positioning and of fixing the end-fitting in the tubular body consist of a peg projecting radially toward the inside of the tubular body and of an axial slot formed in the exterior wall surface of the end-fitting starting from its end that is introduced into the tubular body and ending in a transverse groove.

The end-fitting is fixed into the tubular body using an axial movement followed by a rotational movement, in the manner of a bayonet-type fixing.

In another embodiment of this outlet, the means of fixing the end-fitting in the tubular body consist of recesses opening transversely into the wall surfaces of the tubular body or of the end-fitting and in which shaped elements such as balls, pushed elastically and belonging respectively to the end-fitting or to the tubular body are intended to engage.

4. BRIEF DESCRIPTION OF THE DRAWING

In any event, the invention will be clearly understood with the aid of the description which follows, with reference to the appended diagrammatic drawing which depicts, by way of non-limiting examples, two embodiments of this outlet:

5. DESCRIPTION OF THE PREFERRED EMBODIMENTS

Figure 1:
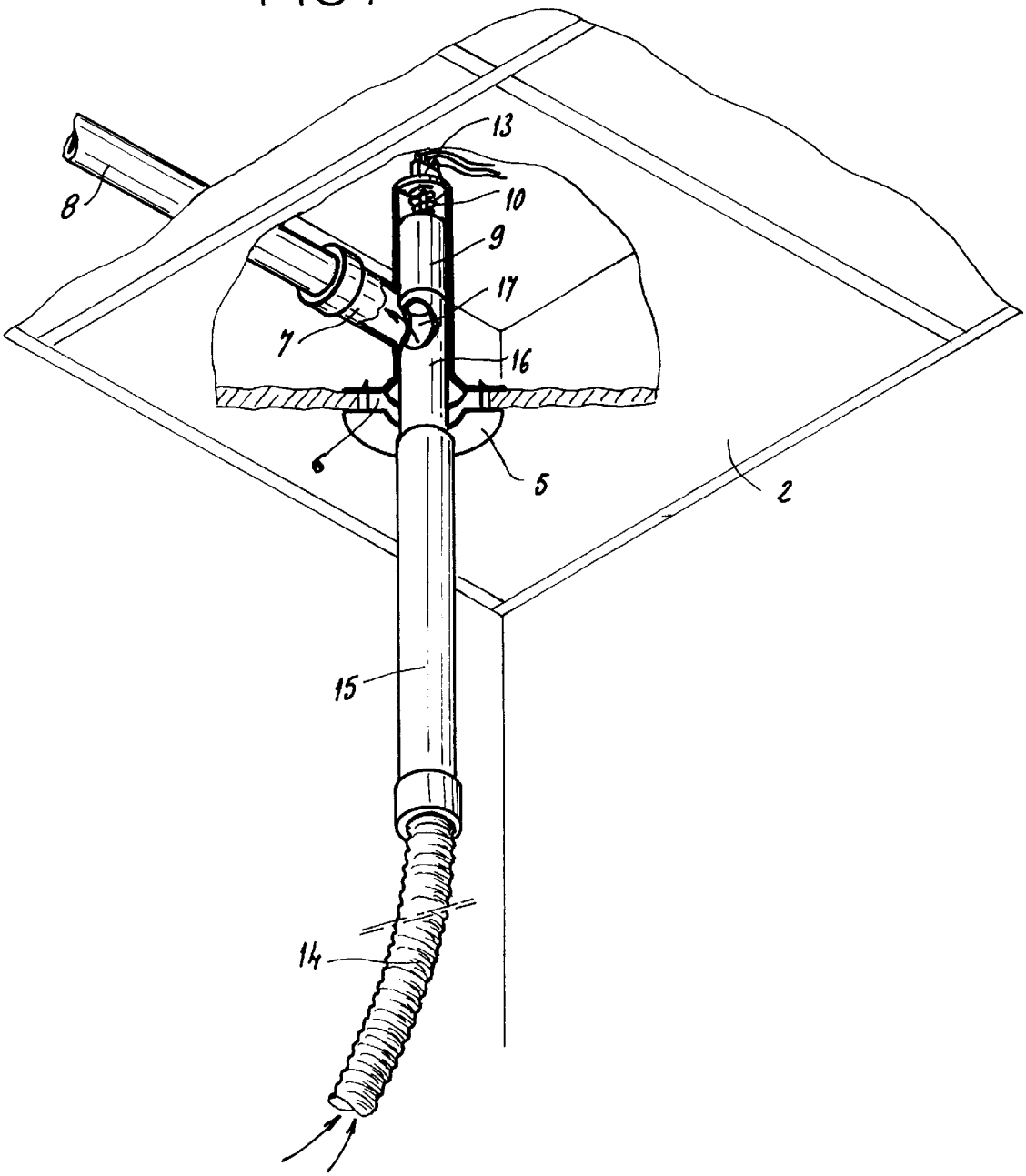
FIG. 1 is a perspective view of this outlet associated with a ceiling, in the position in which a vacuum-cleaning hose is connected.
Figure 2:
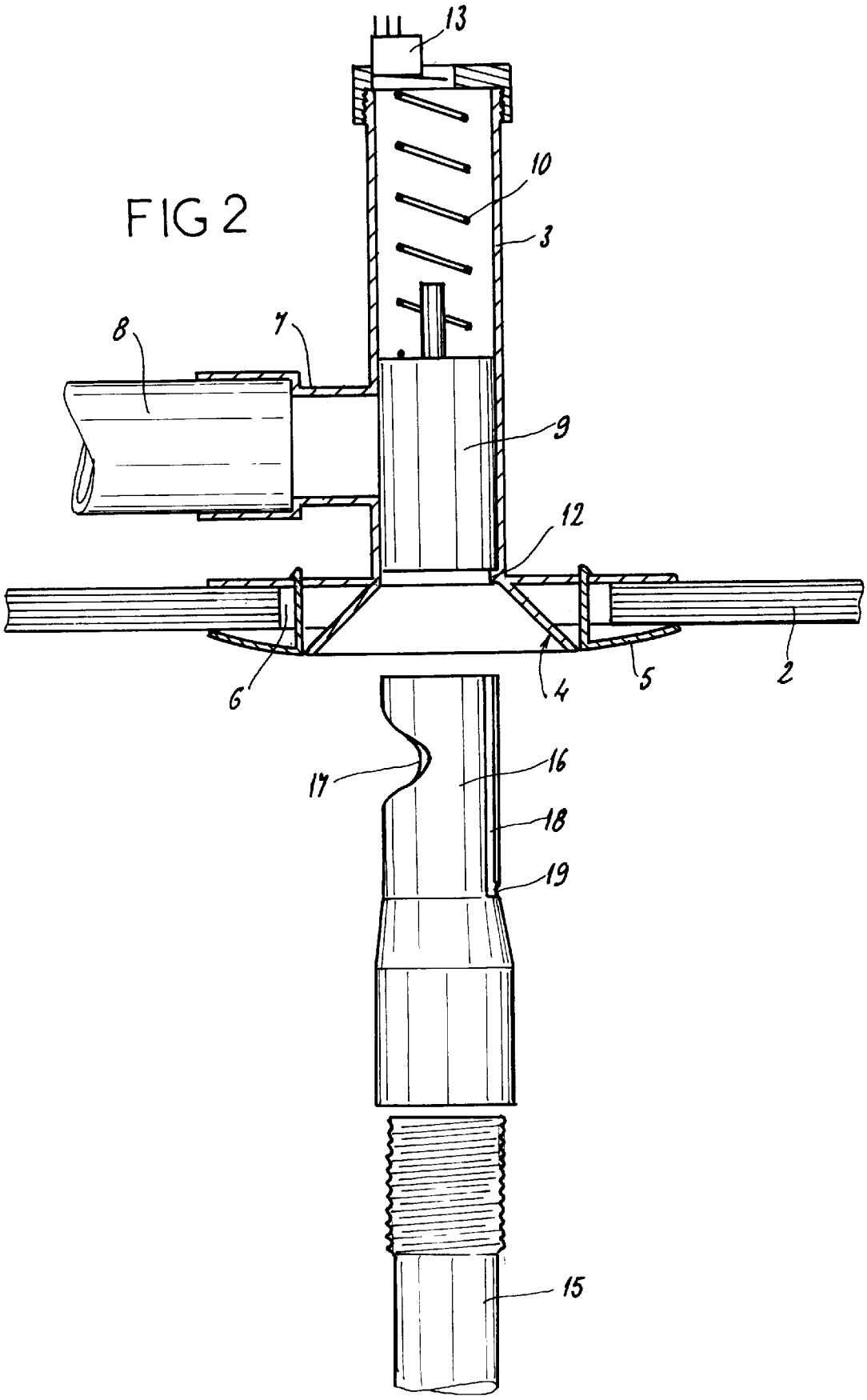
FIGS. 2 and 3 are two views in longitudinal section of this outlet, respectively prior to connection and after connection of the vacuum-cleaning hose connection end-fitting.
Figure 3:
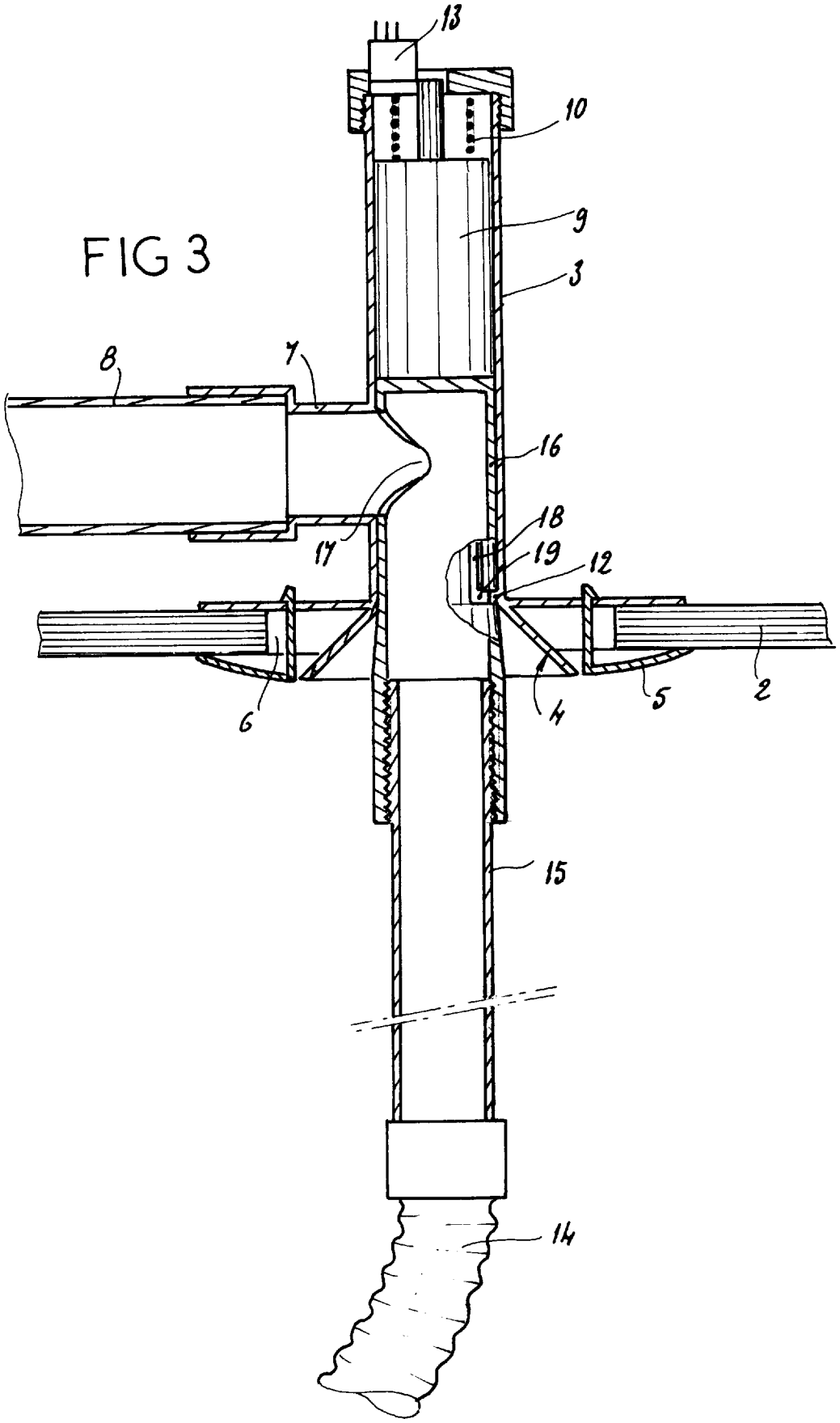

The outlet depicted in FIGS. 1 to 3 is intended to be mounted in the ceiling, and is more particularly suited to a building that is equipped with false-ceiling tiles 2. The outlet according to the invention comprises a tubular body 3, of which an open end, which has an introduction cone 4, is fixed by a collar 5 to a false-ceiling tile 2 in which an opening 6 is made. The tubular body 3 is therefore located in the space that lies between the false ceiling and the tiling forming the roofing of the room. The tubular body 3 comprises a sleeve 7 opening radially near to its lower end, and used to connect to a pipe 8 for connecting with a vacuum-cleaning unit. The body 3, which is tubular and of circular cross section, serves to house a sliding piston 9 pushed towards the free end of the body by a spring 10.

In the position depicted in FIG. 2, the piston 9 rests against a peg 12 situated at the free end of the body 3 and plugs off the pipe 8 connected to the vacuum-cleaning unit. The other end of the tubular body is equipped with a microwitch 13 which is actuated by the piston 9 when the piston 9 is in the position pushed back into the body 3, as shown in FIG. 3. This microwitch 13, when actuated, switches on the vacuum-cleaning unit.

The vacuum-cleaning device also comprises a flexible hose 14 equipped, at one of its ends, with a brush, not depicted in the drawing. At its other end, the flexible hose is equipped with a length of rigid tube 15, for example made of metal, a few tens of centimeters long and to the other end of which an end-fitting 16 is fixed. The end-fitting 16 is intended to be engaged in the body 3, pushing the piston 9 toward the closed end thereof. The end-fitting 16 comprises a radial opening 17 intended to be opposite the vacuum-cleaning pipe 8 when the end-fitting is in the position of maximum engagement into the tubular body. The end-fitting 16 comprises, starting from its end that is introduced into the body 3, a longitudinal slot 18 opening into a transverse groove 19. In the position of non-use of the installation, the body 3 is in the position depicted in FIG. 2.

To switch on the vacuum-cleaning unit, the operator takes the length of rigid tube 15 and introduces the end-fitting 16 into the tubular body 3, positioning the slot 18 opposite the peg 12. At the end of a travel, the operator twists the end-fitting inside the body so that the peg 12 engages in the groove 19 up to the end-of-travel position, in which the opening 17 is opposite the vacuum-cleaning pipe 8. In the course of this movement, the piston 9 is displaced toward the closed end of the body 3 and actuates the microwitch 13, switching on the vacuum-cleaning unit. At the end of vacuum-cleaning, the operator does the reverse, first of all twisting the end-fitting relative to the body then withdrawing this fitting axially. The piston 9, pushed by the spring 10, returns to the closed position plugging the opening of the body and plugging the vacuum-cleaning pipe 8. As the microwitch 13 is deactivated, the vacuum-cleaning unit is switched off.

Figure 4:
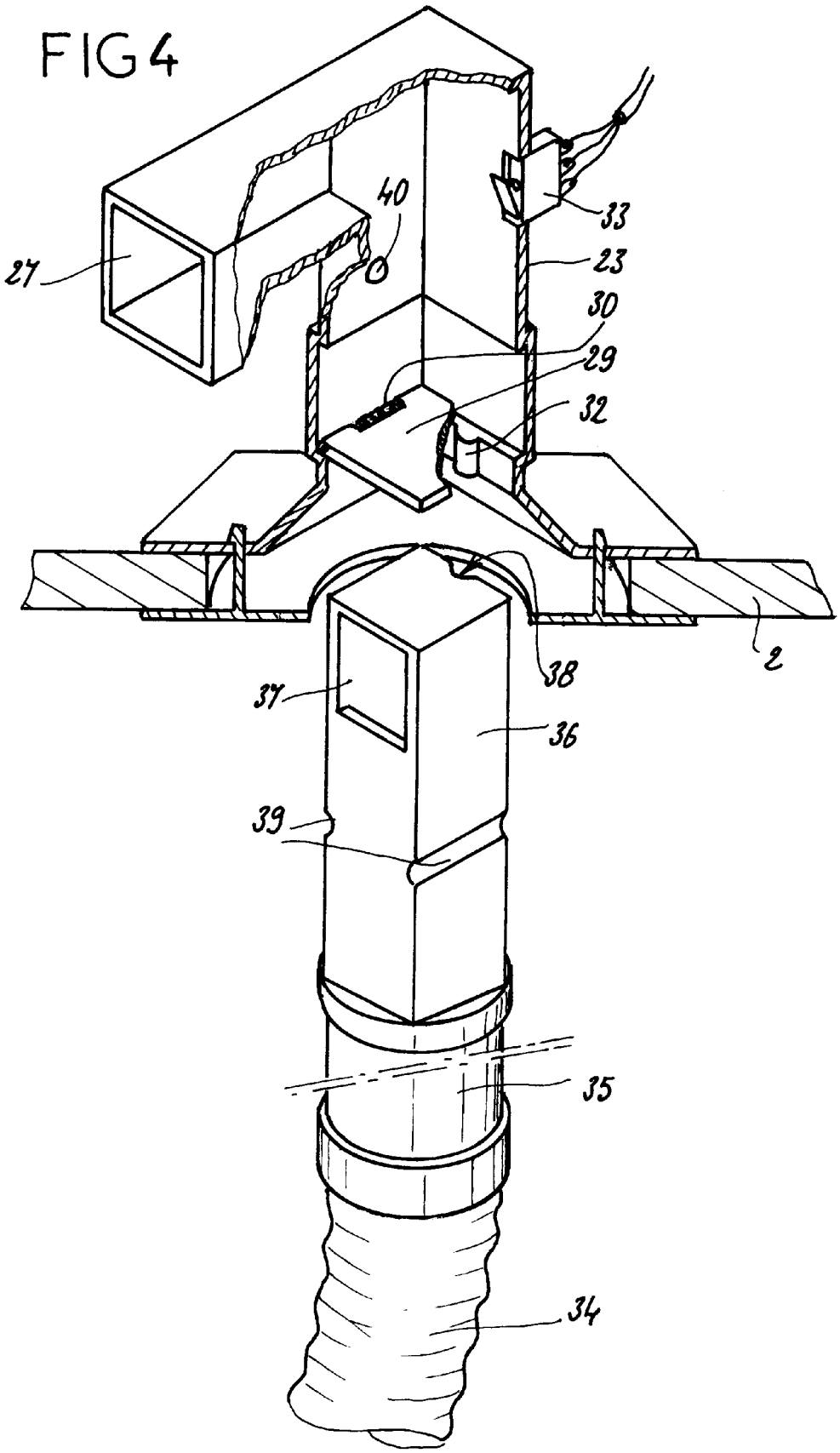
FIG. 4 is a perspective view partially with cutaway and partially in longitudinal section, of a second embodiment of this outlet, associated with a ceiling, in the position in which the vacuum-cleaning hose connection end-fitting is disconnected.

FIG. 4 depicts another embodiment of this outlet, also mounted in a false-ceiling tile 2. In this case, the body 23 is of square cross section, as is the end-fitting 36. The body 23 is plugged by a flap 29 mounted so that it can pivot about a horizontal axis and kept in the closed position by a spring 30. As in the previous case, the connection 27 for the pipe that connects with the vacuum-cleaning unit is formed laterally. In this embodiment, a microwitrch 33 for operating the vacuum-cleaning unit is arranged laterally in the body 23 and is actuated directly by the end-fitting 36. The end-fitting 36 has a transverse opening 37 for communicating with the network that connects to the unit. The end-fitting 36 is mounted at one end of a length of rigid tube 35, itself mounted at one end of a flexible hose 34. The end-fitting 36 is angularly positioned inside the pipe 23 by the interaction between a rib 32 borne by the body and a slot 38 borne by the end-fitting. The locking means consist of two recesses 39 formed in two wall surfaces of the end-fitting 36 and in which shaped elements 40 consisting, for example, of balls, pushed elastically inward and passing through two opposed wall surfaces of the body 23 are intended to engage.

The way in which the outlet of FIG. 4 works is the same as the way in which the outlet of FIGS. 1 to 3 work except that there is no need to rotate the end-fitting at the end of its engagement in the tubular body.

Figure 5:
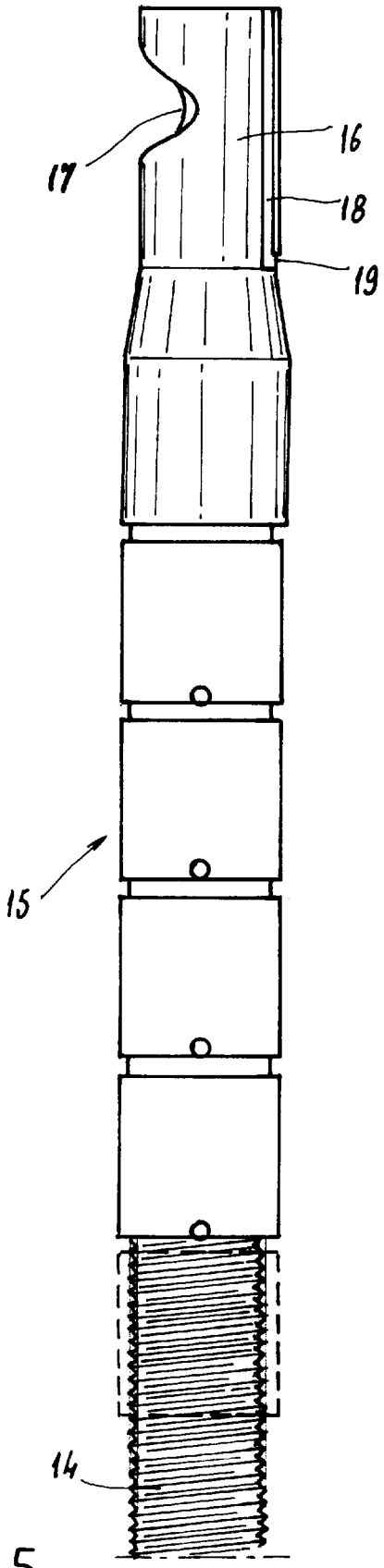
FIG. 5 is a side elevational view of an alternative vacuum-cleaning hose for use in the present invention.

FIG. 5 is a side elevational view of an alternative embodiment of the present invention. In this alternative embodiment, the flexible hose 14 is connected at one end to the rigid tube 15 which connects at an opposite end to the end-fitting 16. The rigid tube 15 is of adjustable length and is formed of at least several rigid elements joined together end to end or which may also be telescopic relative to each other to permit the length of the rigid tube 15 to vary.

Figure 6:
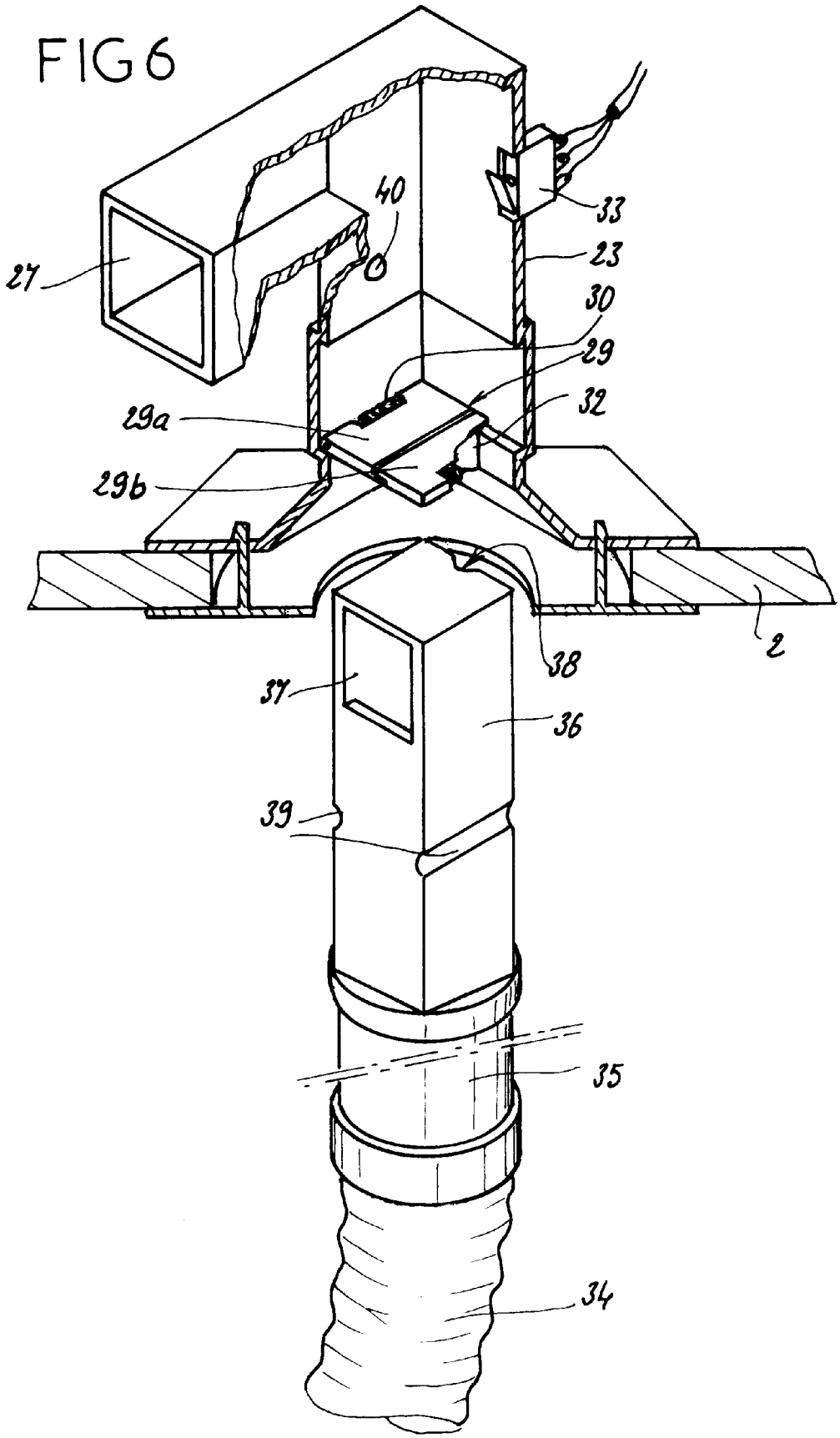
FIG. 6 is a perspective view partially with cutaway and partially in longitudinal section, of a third embodiment of this outlet, associated with a ceiling, in the position in which the vacuum-cleaning hose connection end-fitting is disconnected.

FIG. 6 depicts another embodiment of this outlet, also mounted in a false-ceiling tile 2. In this other embodiment, the flap 29 actually comprises a first flap 29*a* and a second flap 29*b* both of which are mounted so that they can pivot about a horizontal axis and be kept in a closed position by a pair of springs 30. The flaps 29*a* and 29*b* each pivot about the respective horizontal axis when the end-fitting 36 is inserted into the body 23 to lock the end-fitting 36 therein and actuate the unit.

As is clear from the foregoing, the invention affords a great improvement to the existing technique by providing an outlet for connecting a vacuum-cleaning hose to a centralized vacuum-cleaning installation which is of a simple structure, allowing this outlet to be positioned in the ceiling, something which is particularly advantageous especially in commercial premises or offices, while being very practical for the operator to use.

As goes without saying, the invention is not restricted merely to the embodiments of this outlet which have been described hereinabove by way of examples; on the contrary, it encompasses all alternative forms thereof. Thus, in particular, the opening formed in the end-fitting for allowing the flexible hose to communicate with the pipe connected to the vacuum-cleaning unit could be not transverse to the end-fitting but axial thereto, or alternatively the means of relaying control information could consist not of an electrical contact but of a pneumatic sensor, for example, without this in any way departing from the scope of the invention.

I claim:

1. A vacuum cleaner assembly for mounting in a surface of a room, the vacuum cleaner assembly comprising:

a vacuum-cleaning unit including a vacuum-cleaning hose having a rigid end-fitting mounted at one end of the vacuum-cleaning hose, the end-fitting having an outer surface with an opening formed therein, the end-fitting including a guide member formed therein, the end-fitting being releasably mounted to the vacuum-cleaning hose;

an outlet having a body for mounting in the surface of the room, the body having an open first end and an opposing second end with a channel extending therethrough from the open first end to the second end, the open first end being sealed by a retractable member which retracts from a first position to receive the end-fitting of the vacuum-cleaning hose to a second position, the outlet having a switch disposed therein for signaling the vacuum-cleaning unit to turn on when the retractable member is in the second position, the body including a sleeve extending outwardly from the outlet, the sleeve having an open first end and an open second end which forms an entrance into the channel of the outlet, the sleeve for receiving a member which connects to the vacuum-cleaning unit, the retractable member for actuating the switch when the end-fitting is received within the outlet and orientates the retractable member in the second position, the outlet further including a locking member for releasably locking the end-fitting into the outlet; and wherein the end-fitting is inserted into the channel of the outlet until the locking member of the outlet engages the guide member of the end-fitting so as to releasably lock the end-fitting within the outlet, the opening formed in the end-fitting being orientated so that the opening communicates with the open second end of the sleeve, the retractable member actuating the switch when the end-fitting is releasably locked within the outlet and the retractable member is in the second position.

2. The vacuum cleaner assembly as set forth in claim 1, wherein the body comprises a tubular member and is mounted to the surface at a right angle to the surface.

3. The vacuum cleaner assembly as set forth in claim 1, wherein further including:

a rigid tube having a first end and an opposing second end, the end-fitting being connected to the first end and the opposing second end of the rigid tube being connected to a flexible hose.

4. The vacuum cleaner assembly as set forth in claim 1, wherein the rigid tube is of an adjustable length, the rigid tube being made from several rigid elements joined together end to end or which are telescopic.

5. The vacuum cleaner assembly as set forth in claim 1, wherein the sleeve is integrally formed with the tubular body and extends from the tubular body such that a right angle is formed between the sleeve and the tubular body.

6. The vacuum cleaner assembly as set forth in claim 1, wherein the retractable member comprises:

a piston disposed within the channel of the tubular body, the piston being driven into the first position by a spring, the piston sliding between the first position and the second position, the piston blocking off the second opening of the sleeve in the first position to prevent communication between the sleeve and the vacuum-hose, wherein in the second position, the end-fitting is at an end of its engagement travel within the channel of the tubular body and the opening formed in the end-fitting is aligned with the second opening of the sleeve to permit the vacuum-cleaning hose to communicate with the tube connected to the vacuum-cleaning unit.

7. The vacuum cleaner assembly as set forth in claim 1, wherein the retractable member comprises:

a flap made of one or more parts subject to action of a spring which keeps the flap in a closed position, each part of the flap being articulated about an axis which is at a right angle to an axis of the tubular body so that the flap can pivot into the tubular body as the end-fitting is introduced into the tubular body.

8. The vacuum cleaner assembly as set forth in claim 1, wherein the switch for relaying control information for switching the vacuum-cleaning unit on is actuated by the retractable member.

9. The vacuum cleaner assembly as set forth in claim 1, wherein the switch for relaying control information for switching the vacuum-cleaning on is actuated by contact between the retractable member and the switch when the retractable member is in the second position.

10. The vacuum cleaner assembly as set forth in claim 1, wherein the locking member comprises a peg extending from the tubular body into the channel formed therein and the guide member comprises an axial slot formed in an exterior wall of the end-fitting, wherein the peg engages the axial slot to releasably attach the end-fitting within the tubular body.

11. The vacuum cleaner assembly as set forth in claim 1, wherein the tubular body further includes:

at least one groove formed transversely in an outer surface of the end-fitting which engage the locking member which extends from the inner surface of the tubular body, the locking member comprising at least one elastic ball which releasably engages the at least one groove to releasably attach the end-fitting within the tubular body.

12. The vacuum cleaner assembly as set forth in claim 1, wherein the switch is disposed at the closed second end of the tubular body and the retractable member comprises a piston including a body and a piston member extending therefrom, the piston member contacting the switch when the retractable member is in the second position.

13. The vacuum cleaner assembly as set forth in claim 1, wherein the member received within the sleeve comprises a tubular member.

14. The vacuum cleaner assembly as set forth in claim 1, wherein the surface comprises a ceiling tile.

15. An outlet for connecting a vacuum-cleaning hose to a centralized vacuum-cleaning installation including a connector member which connects the outlet to a vacuum-cleaning unit, the vacuum-cleaning hose having a hose portion connected at one end to an end-fitting which is open at both ends and has a side opening formed therein, the outlet comprising:

a body having an open first end and an opposing second end with a channel extending therethrough from the open first end to the second end, the open first end being sealed by a retractable member which retracts from a first position to receive the end-fitting of the vacuum-cleaning hose to a second position, the outlet having a switch disposed therein for signaling the vacuum-cleaning unit to turn on when the retractable member is in the second position, the body including a sleeve extending outwardly from the outlet, the sleeve having an open first end and an open second end which forms an entrance into the channel of the outlet, the sleeve for receiving the connector member which connects the vacuum-cleaning unit to the outlet body, the retractable member for actuating the switch when the end-fitting is received within the outlet and displaces the slidably member towards the closed second end and orientates the retractable member in the second position, the outlet further including a locking member for releasably locking the end-fitting into the outlet.

16. The outlet as set forth in claim 15, wherein the body comprises a tubular member.

17. The outlet as set forth in claim 15, wherein the retractable member comprises a slidable piston which travels within the body from the first position to the second position.

18. The outlet as set forth in claim 15, wherein the sleeve comprises a tubular member which connects to the connector member which comprises a tubular pipe.

19. The outlet as set forth in claim 15, wherein the retractable member comprises a pivotable flap which covers the open first end in a first position and pivots to a second position upon insertion of the end-fitting into the body.

20. The outlet as set forth in claim 15, wherein the switch for relaying control information for switching the vacuum-cleaning unit on is actuated by the retractable member.

21. The outlet as set forth in claim 15, wherein the locking member comprises a peg extending inwardly into the channel from a wall of the body.

22. An outlet for connecting a vacuum-cleaning hose to a centralized vacuum-cleaning installation including a connector member which connects the outlet to a vacuum-cleaning unit, the vacuum-cleaning hose having a hose portion connected at one end to an end-fitting which is open at both ends and has a side opening formed therein, the outlet comprising:

a body having an open first end and an opposing second end with a channel extending therethrough from the open first end to the second end, the open first end being sealed by a retractable member which retracts from a first position to a second position to receive the end-fitting of the vacuum-cleaning hose, the outlet having a switch disposed therein for signaling the vacuum-cleaning unit to turn on when the retractable member is in the second position, the body including an opening formed therein for receiving the connector member which connects the vacuum-cleaning unit to the outlet body, the retractable member for actuating the switch when the end-fitting is received within the outlet and orientates the retractable member in the second position, the outlet further including a locking member for releasably locking the end-fitting into the outlet.

23. The outlet as set forth in claim 22, further including:

a sleeve extending outwardly from the body, the sleeve having a channel extending therethrough, wherein the channel is aligned with the opening formed in the body so that the connecting member is in communication with the vacuum-cleaning hose.

* * * * *

UNITED STATES PATENT AND TRADEMARK OFFICE

CERTIFICATE OF CORRECTION

PATENT NO. : 6,143,996
DATED : November 7, 2000
INVENTOR(S) : Sri Rajah Skanda

It is certified that error appears in the above-identified patent and that said Letters Patent is hereby corrected as shown below:

Column 2,
Line 10, after “vacuum - cleaning” delete “cleaning”

Column 4,
Line 7, delete “microwitch 13” and insert therefor -- microswitch 13 --
Line 9, after “This” delete “microwitch 13” and insert therefor -- microswitch 13 --
Line 34, after “the”, second occurrence, delete “microwitch” and insert therefor -- microswitch --
Line 41, delete “microwitch” and insert therefor -- microswitch --
Line 50, after “a” delete “microwitrch 33” and insert therefor -- microswitch 13 --

Signed and Sealed this

Eighteenth Day of November, 2003

JAMES E. ROGAN
*Director of the United States Patent and Trademark Office*